US009086672B2

(12) United States Patent
Tokuda

(10) Patent No.: US 9,086,672 B2
(45) Date of Patent: Jul. 21, 2015

(54) IMAGE FORMING APPARATUS

(75) Inventor: Takashi Tokuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/129,389

(22) PCT Filed: Jun. 8, 2012

(86) PCT No.: PCT/JP2012/064737
§ 371 (c)(1),
(2), (4) Date: Dec. 26, 2013

(87) PCT Pub. No.: WO2013/002005
PCT Pub. Date: Jan. 3, 2013

(65) Prior Publication Data

US 2014/0126937 A1 May 8, 2014

(30) Foreign Application Priority Data

Jun. 29, 2011 (JP) ..... 2011-143699

(51) Int. Cl.
*G03G 15/01* (2006.01)
*G03G 21/00* (2006.01)

(52) U.S. Cl.
CPC ..... *G03G 21/0011* (2013.01); *G03G 15/0189* (2013.01); *G03G 2215/0132* (2013.01); *G03G 2215/0193* (2013.01)

(58) Field of Classification Search
CPC ..... G03G 15/01; G03G 15/16; G03G 21/10; G03G 21/00; G03G 21/14
See application file for complete search history.

(56) References Cited

U.S. PATENT DOCUMENTS

2002/0034401 A1* 3/2002 Yanagida ..... 399/167
2002/0172532 A1* 11/2002 Senda ..... 399/167
2007/0098471 A1* 5/2007 Kawamoto et al. ..... 399/343

FOREIGN PATENT DOCUMENTS

JP 08-166754 A 6/1996
JP 3310128 B2 5/2002
JP 2004-102178 A 4/2004
JP 2009-175657 A 8/2009
JP 2010-243829 A 10/2010
JP 2011-137937 A 7/2011

OTHER PUBLICATIONS

International Search Report for corresponding International Application No. PCT/JP2012/064737 mailed Jul. 24, 2012.

* cited by examiner

*Primary Examiner* — Clayton E Laballe
*Assistant Examiner* — Ruifeng Pu
(74) *Attorney, Agent, or Firm* — Renner, Otto, Boisselle & Sklar, LLP

(57) ABSTRACT

An image forming apparatus (10) capable of releasing pressure of toner accumulated between photoreceptor drums and cleaning blades without affecting the life of the photoreceptor drums includes photoreceptor drums (21A to 21D), an intermediate transfer belt (31), cleaning blades (250A to 250D), a cam mechanism (36), and a drive motor (26). The photoreceptor drums (21B to 21D) bear a toner image. The toner image is transferred from the photoreceptor drums (21A to 21D) to the intermediate transfer belt. The cleaning blades (250A to 250D) remove toner remaining on the photoreceptor drums (21A to 21D) after the toner image transfer. The cam mechanism (36) switches, after an image forming process, a contact state of the photoreceptor drums (21A to 21D) and the intermediate transfer belt (31) to a separation state. The drive motor (26) rotates the photoreceptor drums (21B to 21D) backward after switching the contact state to the separation state.

5 Claims, 8 Drawing Sheets

IMAGE FORMING APPARATUS

TECHNICAL FIELD

The present invention relates to an image forming apparatus capable of releasing pressure of toner accumulated between a photoreceptor drum and a cleaning blade.

BACKGROUND ART

As a cleaning means that removes unwanted substances such as toner remaining on a photoreceptor drum after a toner image has been transferred from the photoreceptor drum, a cleaning blade has a front end ridgeline portion that is slidably contacted with the photoreceptor drum to remove toner on the photoreceptor drum. Accordingly, toner has accumulated between the photoreceptor drum and the cleaning blade by continuous use. When the remaining toner is left as it is, the toner passes through between the photoreceptor drum and the cleaning blade, which may cause the toner to be scattered or may generate an abnormal image such as a formed image on which a black streak or a white streak appears.

Thus, an image forming apparatus has been disclosed which includes a driving portion capable of rotatably driving a photoreceptor drum in both forward and backward directions and which separates and removes toner attached on a front end ridgeline portion of a cleaning blade from the front end ridgeline portion by rotating the photoreceptor drum backward during no image formation, that is, in a direction opposite to a forward rotating direction during image formation (see Patent Literature 1, for example).

CITATION LIST

Patent Literature

Patent Literature 1: Japanese Patent Laid-Open Publication No. 2009-175657

SUMMARY OF INVENTION

Technical Problem

However, in a secondary transfer type image forming apparatus, a photoreceptor drum and an intermediate transfer belt are contacted each other, so that the photoreceptor drum and the intermediate transfer belt will be slidably contacted if the technique disclosed in Patent Literature 1 is applied to the photoreceptor drum and the intermediate transfer belt that are in contact with each other, which may affect the life of the photoreceptor drum.

In view of the foregoing problems, it is an object of the present invention to provide an image forming apparatus capable of releasing pressure of toner accumulated between a photoreceptor drum and a cleaning blade without affecting the life of the photoreceptor drum.

Solution to Problem

An image forming apparatus according to a preferred embodiment of the present invention is a tandem type image forming apparatus that performs a monochrome image forming process and a color image forming process. The image forming apparatus according to a preferred embodiment of the present invention includes a plurality of first photoreceptor drums, a second photoreceptor drum, an intermediate transfer belt, a plurality of cleaning blades, a switching mechanism, and a backward rotating mechanism.

The plurality of first photoreceptor drums bear a single color toner image on the surface of each of the first photoreceptor drums. The second photoreceptor drum bears a black toner image on the surface of the second photoreceptor drum. In a state in which the intermediate transfer belt is contacted with the plurality of first photoreceptor drums and the second photoreceptor drum, a toner image is transferred from at least one of the plurality of first photoreceptor drums and the second photoreceptor drum onto the intermediate transfer belt. The plurality of cleaning blades are slidably contacted with the plurality of first photoreceptor drums and the second photoreceptor drum, respectively, in order to remove toner remaining on the plurality of first photoreceptor drums and the second photoreceptor drum after the toner image has been transferred.

The switching mechanism switches a contact state in which the plurality of first photoreceptor drums and the second photoreceptor drum are contacted with the intermediate transfer belt to a separation state in which the plurality of first photoreceptor drums and the second photoreceptor drum are separated from the intermediate transfer belt after the color image forming process has ended. The backward rotating mechanism rotates the plurality of first photoreceptor drums backward after the switching mechanism has switched the contact state of the plurality of first photoreceptor drums and the second photoreceptor drum, and the intermediate transfer belt to the separation state.

With this configuration, backward rotation of the plurality of first photoreceptor drums can release pressure of toner accumulated between the plurality of first photoreceptor drums and the plurality of cleaning blades, which can prevent an image defect due to passing through of the toner from generating.

In addition, the backward rotation of the plurality of first photoreceptor drums is performed in a state in which the plurality of first photoreceptor drums and the second photoreceptor drum are not in contact with the intermediate transfer belt, so that the plurality of first photoreceptor drums and the intermediate transfer belt are not slidably contacted each other during the backward rotation, which can reduce effects on the life of the plurality of first photoreceptor drums and can also reduce a burden on a rotation driving system of the plurality of first photoreceptor drums.

Advantageous Effects of Invention

An image forming apparatus according to a preferred embodiment of the present invention can release pressure of toner accumulated between a photoreceptor drum and a cleaning blade without affecting the life of the photoreceptor drum.

DESCRIPTION OF EMBODIMENTS

Hereinafter, an image forming apparatus according to a preferred embodiment of the present invention will be described in detail with reference to the drawings.

Figure 1:
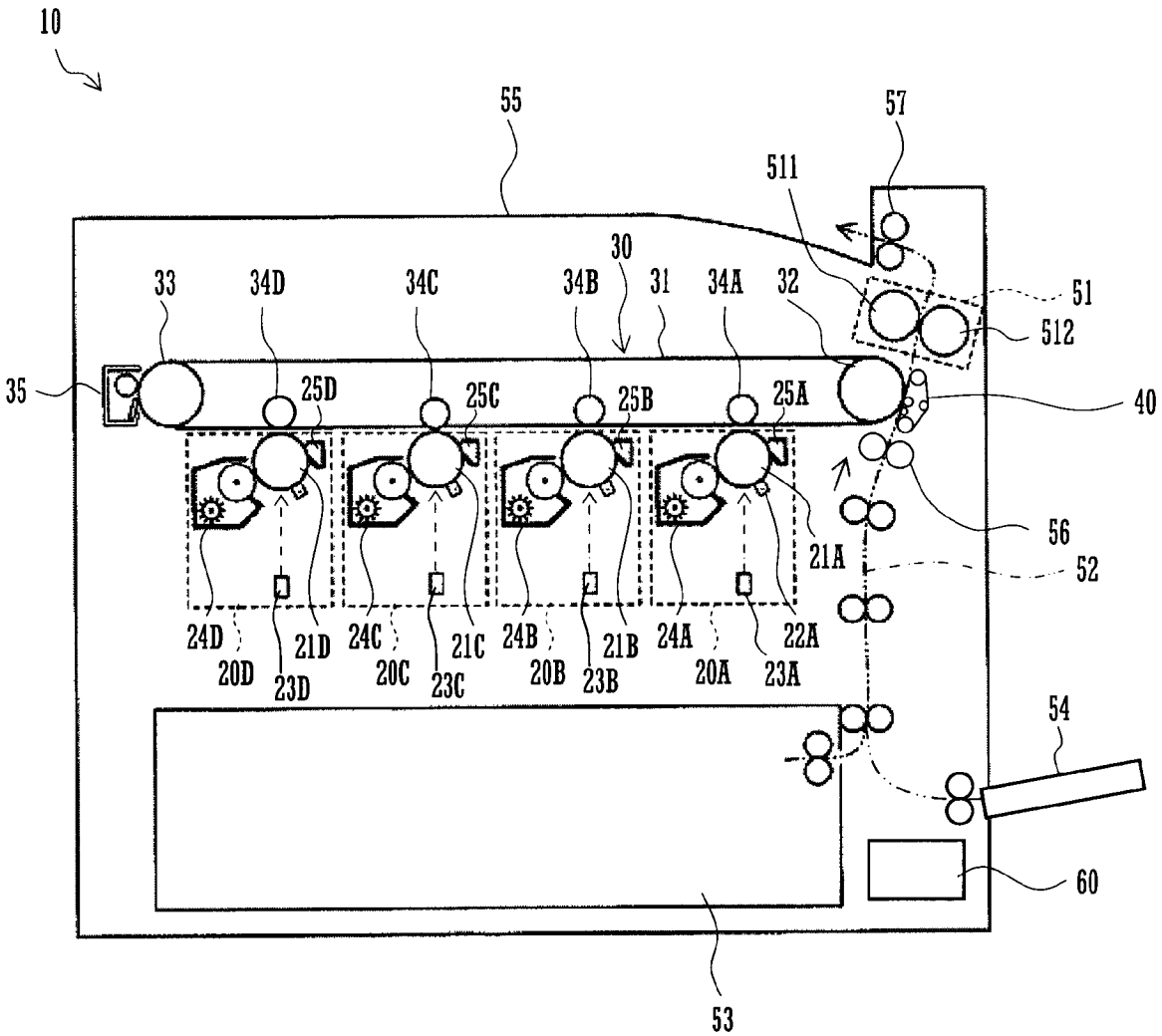
FIG. 1 is a front view illustrating a configuration of an image forming apparatus according to a preferred embodiment of the present invention.

FIG. 1 is a front view illustrating a configuration of an image forming apparatus 10 according to a preferred embodiment of the present invention.

The image forming apparatus 10 is equipped with a plurality of image forming units 20A, 20B, 20C, and 20D, a primary transfer unit 30, a secondary transfer unit 40, a fixing device 51, a paper feed path 52, a sheet feed cassette 53, a manual feed tray 54, a paper output tray 55, and a control portion 60. The control portion 60 comprehensively controls each portion of the image forming apparatus 10. It is to be noted that the image forming units 20A to 20D are appropriately called an image forming unit 20.

The image forming apparatus 10 performs an electrophotographic image forming process by using image data items corresponding to each hue of four colors of black, cyan, magenta, and yellow.

The following description is directed mainly to the image forming unit 20A. The other image forming units 20B to 20D are substantially similar in configuration to the image forming unit 20A. The image forming unit 20A, which is associated with black, includes a photoreceptor drum. 21A, a charger device 22A, an exposure device 23A, a developing device 24A, and a cleaning unit 25A and forms a black toner image through the electrophotographic image forming process.

The photoreceptor drum 21A and the photoreceptor drums 21B, 21C, and 21D with which the image forming units 20B to 20D are equipped, are rotated by a driving force transmitted from a non-illustrated drive motor.

The charger device 22A is disposed to face the peripheral surface of the photoreceptor drum 21A and electrostatically charges the peripheral surface of the photoreceptor drum 21A to a predetermined potential. The exposure device 23A irradiates the peripheral surface of the photoreceptor drum 21A with a laser beam modulated according to a black image data item. The developing device 24A stores black toner therein.

The primary transfer unit 30 has a primary transfer belt 31, a primary transfer driving roller 32, a primary transfer idle roller 33, primary transfer rollers 34A to 34D, and an primary transfer belt cleaning unit 35.

The primary transfer belt 31 is stretched over the primary transfer driving roller 32 and the primary transfer idle roller 33 to move around the rollers in a predetermined direction. The primary transfer rollers 34A to 34D are disposed to face the respective photoreceptor drums 21A to 21D with the primary transfer belt 31 held between the primary transfer rollers and the photoreceptor drums. The regions in which the outer peripheral surface of the primary transfer belt 31 faces the photoreceptor drums 21A to 21D are primary transfer regions.

The cleaning unit 25A collects toner remaining on the peripheral surface of the photoreceptor drum 21A after the primary transfer following a developing step. The secondary transfer belt unit 40 is configured to freely contact with and separate from the primary transfer driving roller 32 with the primary transfer belt 31 held between the unit and the belt. The region in which the intermediate transfer belt 31 and the secondary transfer unit 40 are pressed against each other is a secondary transfer region.

The sheet feed cassette 53 and the manual feed tray 54 store sheets of paper therein. The sheet feed path 52 is configured to guide each of the sheets fed from the sheet feed cassette 53 or the manual feed tray 54 to the paper output tray 55 via the secondary transfer region and the fixing device 51.

A registration roller 56 is disposed near the downstream side of the secondary transfer region in a sheet feed direction. The sheet fed from the sheet feed cassette 53 or the manual feed tray 54 to the paper feed path 52 comes to abut against the registration roller 56 in a stationary state, so that the direction of the sheet is corrected and is supplied to the secondary transfer region by the registration roller 56 that starts rotating at a predetermined timing.

A predetermined secondary transfer electric field is formed in the secondary transfer region, so that a toner image born on the primary transfer belt 31 is secondarily transferred to the sheet. Of the toner born on the primary transfer belt 31, toner remaining on the primary transfer belt 31 without having been transferred to the sheet is collected by the primary transfer belt cleaning unit 35. This prevents color mixture from occurring in the subsequent steps.

The fixing device 51 has a heating roller 511 and a pressure roller 512. The heating roller 511 and the pressure roller 512 are pressed against each other. The fixing device 51 heats and pressurizes the sheet by holding the sheet with a nip portion between the heating roller 511 and the pressure roller 512 while feeding the sheet, thereby firmly fixing and fusing the toner image to the sheet. The sheet on which the toner image thus fixed and fused is output to the paper output tray 55 by a pair of paper output rollers 57.

Figure 2:
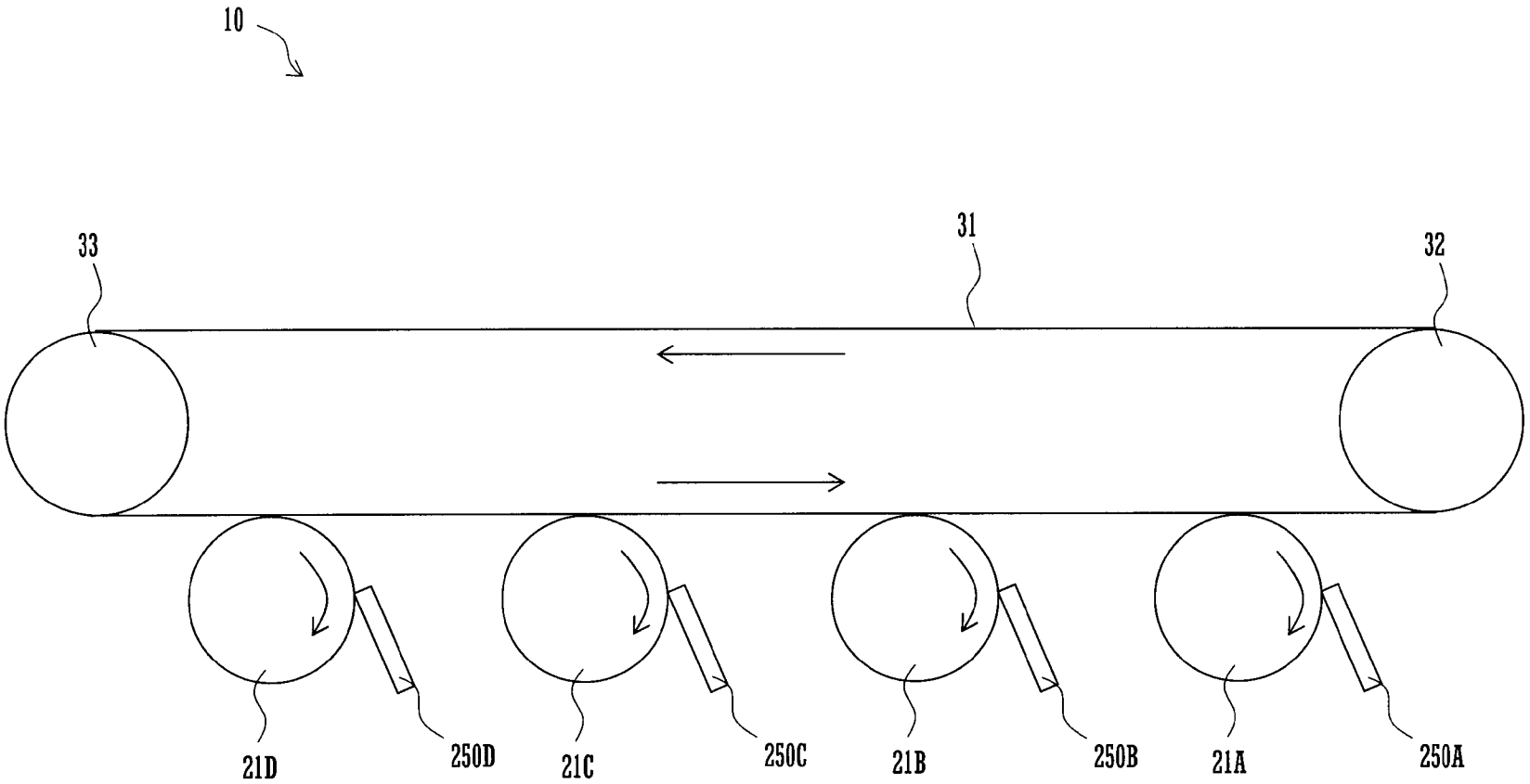
FIG. 2 is a view illustrating a state in which first photoreceptor drums and a second photoreceptor drum are contacted with an intermediate transfer belt.
Figure 3:
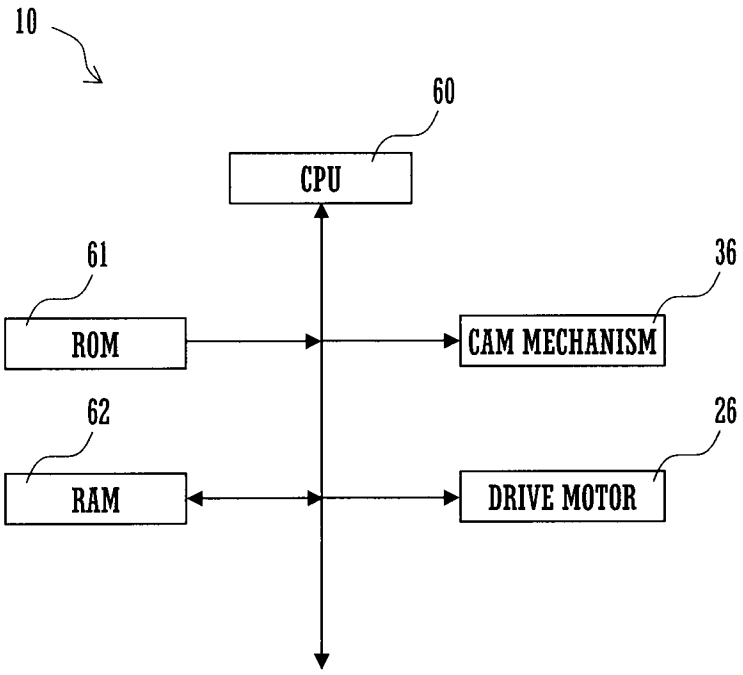
FIG. 3 is a block diagram illustrating a main part of the image forming apparatus according to the preferred embodiment of the present invention.

FIG. 2 is a front view illustrating a main part of the image forming apparatus 10 according to the preferred embodiment of the present invention. FIG. 3 is a block diagram illustrating a main part of the image forming apparatus 10 according to the preferred embodiment of the present invention.

The image forming apparatus 10 is equipped with photoreceptor drums 21A to 21D, an intermediate transfer belt 31, cleaning blades 250A to 250D, a cam mechanism 36, a drive motor 26, a CPU 60, a ROM 61, and a RAM 62. The photoreceptor drums 21B to 21D correspond to the first photoreceptor drum of the present invention. The photoreceptor drum 21A corresponds to the second photoreceptor drum of the present invention. The cam mechanism 36 corresponds to the switching mechanism of the present invention. The drive motor 26 corresponds to the backward rotating mechanism of the present invention.

The photoreceptor drums 21B to 21D bear a single color toner image on the surface of each of the photoreceptor drums. The photoreceptor drum 21A bears a black toner image on the surface of the photoreceptor drum. In a state in which the intermediate transfer belt is contacted with the photoreceptor drums 21A to 21D, a toner image is transferred from at least one of the photoreceptor drums 21A to 21D onto the intermediate transfer belt 31. The cleaning blades 250A to 250D are provided in cleaning units 25A to 25D, respectively, and slidably contacted with the photoreceptor drums 21A to 21D, respectively, in order to remove toner remaining on the photoreceptor drums 21A to 21D after the toner image has been transferred.

The cam mechanism 36 switches a contact state in which the photoreceptor drums 21A to 21D are contacted with the intermediate transfer belt 31 to a separation state in which the photoreceptor drums 21A to 21D are separated from the intermediate transfer belt 31 after the color image forming process has ended. The drive motor 26 rotates the photoreceptor drums 21B to 21D backward after the cam mechanism 36 has switched the contact state of the photoreceptor drums 21A to 21D and the intermediate transfer belt 31 to the separation state. The CPU 60 reads and performs a control program from the ROM 61 and comprehensively controls various portions. The ROM 61 stores the control program read out to the CPU 60. The RAM 62 is used as a working area of the CPU 60.

Figure 4:
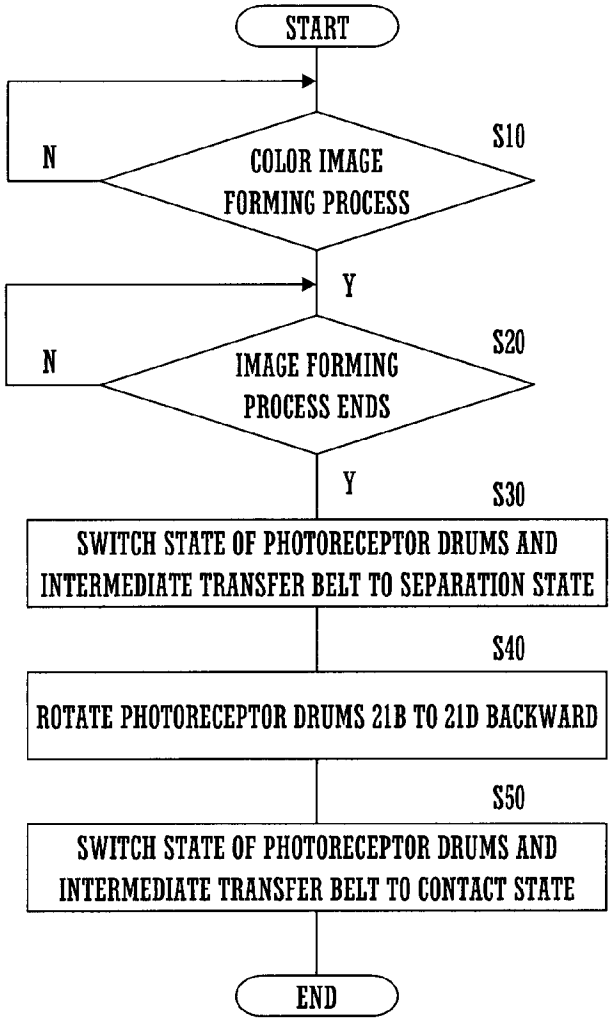
FIG. 4 is a flowchart showing a control process performed by the image forming apparatus according to the preferred embodiment of the present invention.

FIG. 4 is a flow chart showing a control process performed by the image forming apparatus 10 according to the preferred embodiment of the present invention.

Figure 5:
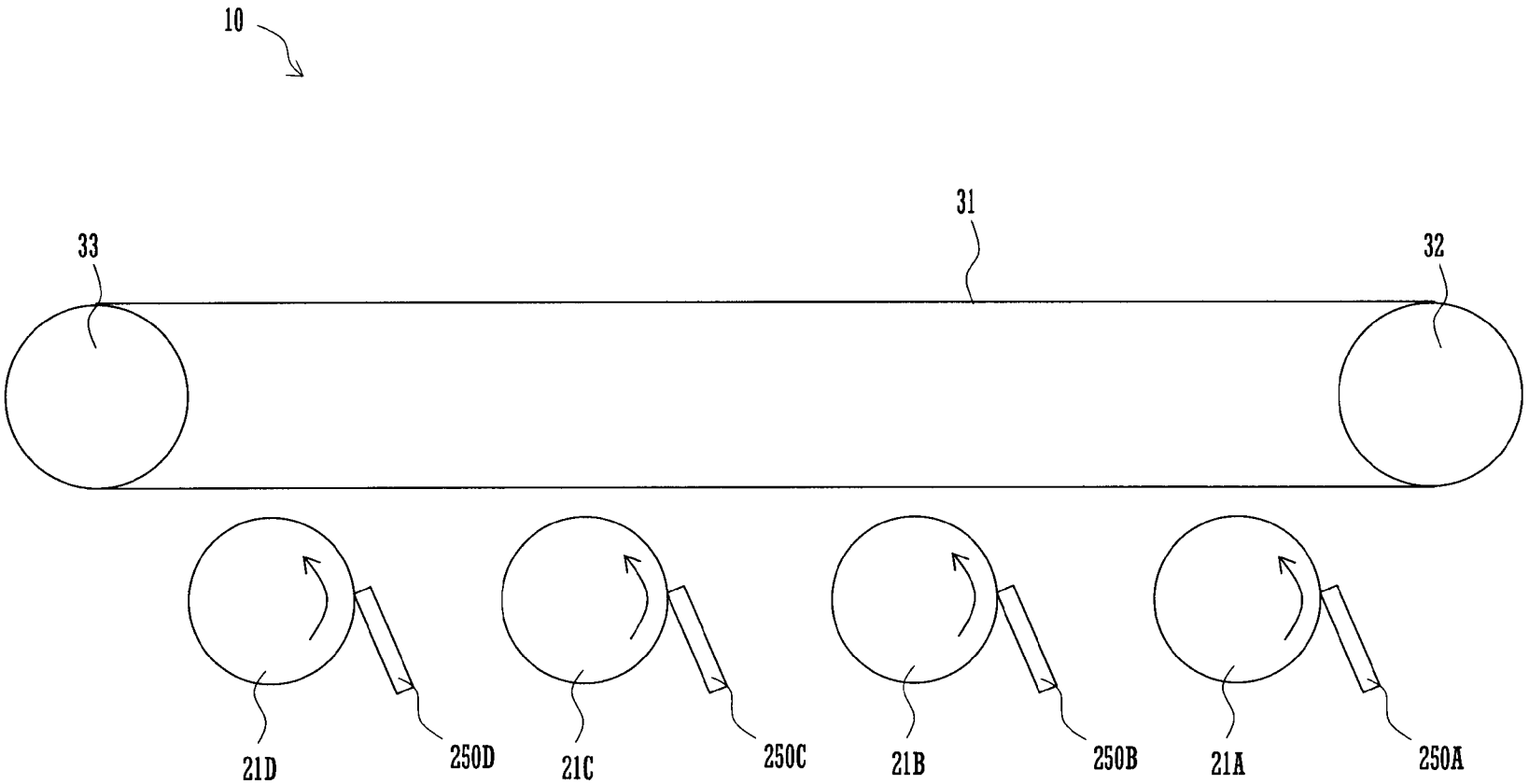
FIG. 5 a view illustrating a state in which the first photoreceptor drums and the second photoreceptor drum are separated from the intermediate transfer belt.

The CPU 60 stands by until a color image forming instruction is issued (N in step S10). When determining that the color image forming instruction has been issued (Y in step S10), the CPU 60 stands by until a color image formation process ends (N in step S20). When determining that the color image formation process has ended (Y in step S20), the CPU 60 performs a control of switching the contact state in which the photoreceptor drums 21A to 21D are contacted with the intermediate transfer belt 31 to the separation state through the cam mechanism 36 (S30). FIG. 5 illustrates the separation state. Subsequently, the CPU 60 performs a control of rotating the photoreceptor drums 21B to 21D backward through the drive motor 26 (S40).

Figure 6:
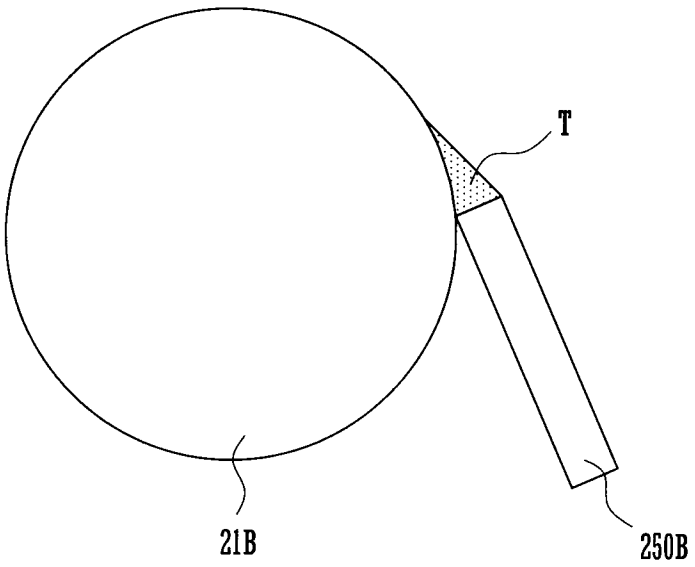
FIG. 6 is a view illustrating a state in which toner is accumulated between a first photoreceptor drum and a cleaning blade.
Figure 7:
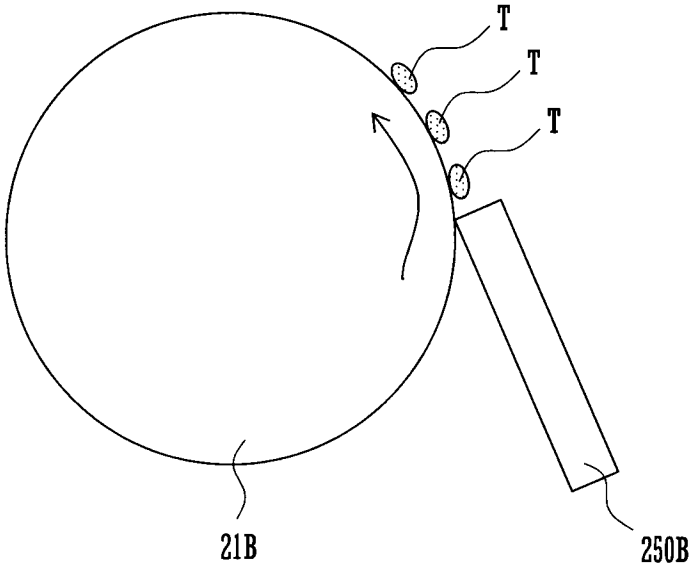
FIG. 7 is a view illustrating a state in which the toner accumulated between the first photoreceptor drum and the cleaning blade is scattered by backward rotation of the first photoreceptor drum.

Before the control of rotating the drums backward is performed, as illustrated in FIG. 6, toner T is accumulated between the photoreceptor drum 21B and the cleaning blade 250B. Ina state in which the accumulated toner is left, when the control of rotating the drums backward is performed, as illustrated in FIG. 7, the toner T is scattered, which releases pressure of the toner T between the photoreceptor drum 21B and the cleaning blade 250B. It should be noted that while FIG. 6 has been directed to the photoreceptor drum 21B, the same may be applied to the photoreceptor drums 21C and 21D.

The CPU 60, after step S40, switches the separation state of the photoreceptor drums 21A to 21D and the intermediate transfer belt 31 to the contact state (S50), and ends the control process of the preferred embodiment of the present invention.

With this configuration, backward rotation of the photoreceptor drums 21B to 21D can release pressure of toner T accumulated between the photoreceptor drums 21B to 21D and the cleaning blades 250B to 250D, which can prevent an image defect due to passing through of the toner T from generating.

In addition, the backward rotation of the photoreceptor drums 21B to 21D is performed in a state in which the photoreceptor drums 21A to 21D are not in contact with the intermediate transfer belt 31, so that the photoreceptor drums 21B to 21D and the intermediate transfer belt 31 are not slidably contacted each other during the backward rotation, which can reduce effects on the life of the photoreceptor drums 21B to 21D and can also reduce a burden on a rotation driving system (a drive motor 26, for example) of the photoreceptor drums 21B to 21D.

It is not preferable that the cam mechanism 36 switch the contact state of the photoreceptor drums 21A to 21D and the intermediate transfer belt 31 to the separation state after the monochrome image forming process has ended and the drive motor 26 rotate the photoreceptor drums 21B to 21D backward after the monochrome image forming process has ended.

After the monochrome image forming process has ended, since the toner T is not accumulated between the photoreceptor drums 21B to 21D and the cleaning blades 250B to 250D, the photoreceptor drums 21B to 21D are not required to be rotated backward by switching the contact state of the photoreceptor drums 21A to 21D and the intermediate transfer belt 31 to the separation state. Thus, effects on the life of the photoreceptor drums 21B to 21D can be reduced and a burden on a rotation driving system (the drive motor 26, for example) of the photoreceptor drums 21B to 21D can be also reduced.

In addition, it is not preferable that the drive motor 26 rotate the photoreceptor drum 21A backward.

Since black toner does not cause the generation of an image defect due to passing through of toner, the photoreceptor drum 21A is not required to be rotated backward. Thus, effects on the life of the photoreceptor drum 21A can be reduced and a burden on a rotation driving system (the drive motor 26, for example) of the photoreceptor drum 21A can be also reduced.

Furthermore, the drive motor 26 may preferably rotate the photoreceptor drums 21B to 21D backward by a minute angle.

Even if the amount of backward rotation of the photoreceptor drums 21B to 21D is by a minute angle, an image defect due to passing through of the toner T can be prevented from generating. Thus, effects on the life of the photoreceptor drums 21B to 21D can be reduced and a burden on a rotation driving system (the drive motor 26, for example) of the photoreceptor drums 21B to 21D can be also reduced.

Specifically, the drive motor 26 may preferably rotate the photoreceptor drums 21B to 21D backward by an angle required to release pressure of the toner T accumulated between the photoreceptor drums 21B to 21D and the cleaning blades 250B to 250D.

If the pressure of the toner T accumulated between the photoreceptor drums 21B to 21D and the cleaning blades 250B to 250D is released, an image defect due to passing through of the toner T can be prevented from generating. Thus, effects on the life of the photoreceptor drums 21B to 21D can be reduced and a burden on a rotation driving system (the drive motor 26, for example) of the photoreceptor drums 21B to 21D can be also reduced.

More specifically, the drive motor 26 may preferably rotate the photoreceptor drums 21B to 21D backward by several millimeters of the peripheral length of each of the photoreceptor drums.

If the photoreceptor drums 21B to 21D are rotated backward by several millimeters of the peripheral length of the photoreceptor drums, the pressure of the toner T accumulated between the photoreceptor drums 21B to 21D and the cleaning blades 250B to 250D can be released, so that an image defect due to passing through of the toner T can be prevented from generating. Thus, effects on the life of the photoreceptor drums 21B to 21D can be reduced and a burden on a rotation driving system (the drive motor 26, for example) of the photoreceptor drums 21B to 21D can be also reduced.

Figure 8:
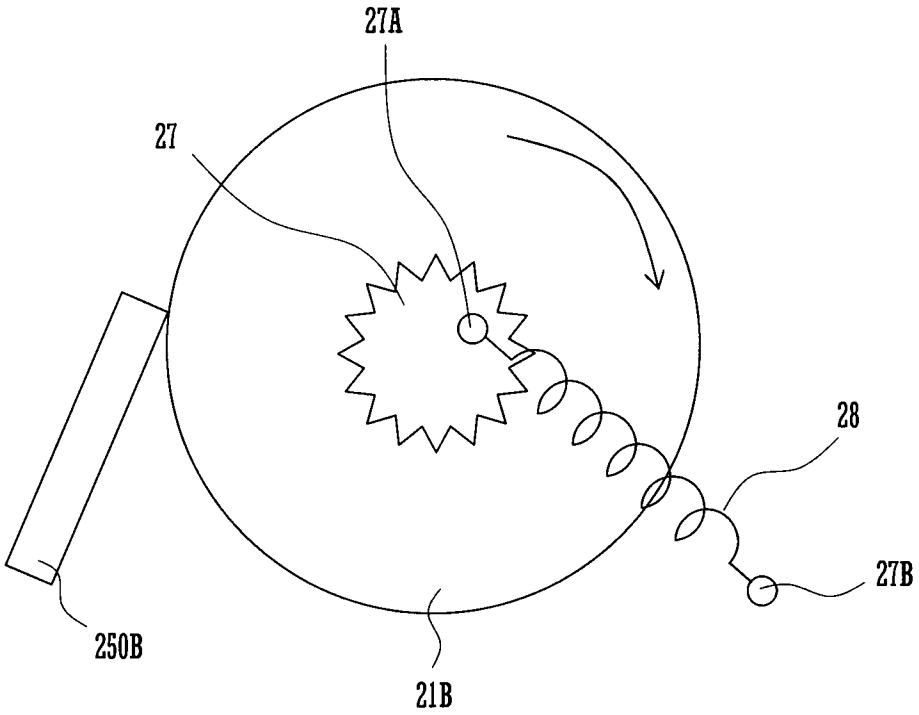
FIG. 8 is a view illustrating a modification example of a backward rotating mechanism.

While the preferred embodiment of the present invention has been directed to the drive motor 26 as a backward rotating mechanism, the present invention is not limited to such a backward rotating mechanism. For example, the configuration illustrated in FIG. 8 may be employed as a backward rotating mechanism.

In other words, the configuration illustrates that the photoreceptor drum 21B is provided with a support shaft 27A on a gear 27 of the rotation driving system of the photoreceptor drum 21B, a support shaft 27B is provided near the photoreceptor drum 21B, and the photoreceptor drum 21B is biased through the gear 27 by supporting a tension spring 28 with the support shafts 27A and 27B. The support shafts 27A and 27B and the tension spring 28 in this configuration correspond to the backward rotating mechanism of the present invention. It is to be noted that the photoreceptor drums 21C and 21D have the same configuration.

Furthermore, by using a clutch not illustrated in this configuration, the photoreceptor drums 21B to 21D can be rotated backward after the color image forming process has ended and the contact state of the photoreceptor drums 21A to 21D and the intermediate transfer belt 31 is switched to the separation state.

With this configuration, since the photoreceptor drums 21B to 21D are not required to be rotated backward by the driver motor 26, a burden on the rotation driving system (the drive motor 26, for example) of the photoreceptor drums 21B to 21D can be reduced.

Finally, the above described embodiments are to be considered in all respects as illustrative and not restrictive. The scope of the present invention is defined not by above described embodiments but by the claims. Further, the scope of the present invention is intended to include all modifications that come within the meaning and scope of the claims and any equivalents thereof.

REFERENCE SIGNS LIST

10 Image forming apparatus
21A Photoreceptor drum
21B Photoreceptor drum
21C Photoreceptor drum
21D Photoreceptor drum
26 Drive Motor
27A Support shaft
27B Support shaft
28 Tension spring
31 Intermediate Transfer Belt
36 Cam Mechanism
250A Cleaning blade
250B Cleaning blade
250C Cleaning blade
250D Cleaning blade

The invention claimed is:

1. An image forming apparatus that is a tandem type and performs a monochrome image forming process and a color image forming process, the image forming apparatus comprising:

a plurality of first photoreceptor drums that bear a single color toner image on a surface of each of the first photoreceptor drums;

a second photoreceptor drum that bears a black toner image on a surface of the second photoreceptor drum;

an intermediate transfer belt onto which a toner image is transferred from at least one of the plurality of first photoreceptor drums and the second photoreceptor drum in a state in which the intermediate transfer belt is contacted with the plurality of first photoreceptor drums and the second photoreceptor drum;

a plurality of cleaning blades that are slidably contacted with the plurality of first photoreceptor drums and the second photoreceptor drum, respectively, in order to remove toner remaining on the plurality of first photoreceptor drums and the second photoreceptor drum after the toner image is transferred;

a switching mechanism that switches a contact state in which the plurality of first photoreceptor drums and the second photoreceptor drum are contacted with the intermediate transfer belt to a separation state in which the plurality of first photoreceptor drums and the second photoreceptor drum are separated from the intermediate transfer belt after the color image forming process has ended; and a backward rotating mechanism that rotates the plurality of first photoreceptor drums backward after the switching mechanism has switched the contact state of the plurality of first photoreceptor drums and the second photoreceptor drum, and the intermediate transfer belt to the separation state, wherein:

the switching mechanism does not switch the contact state of the plurality of first photoreceptor drums and the second photoreceptor drum, and the intermediate transfer belt to the separation state after the monochrome image forming process has ended; and the backward rotating mechanism does not rotate the plurality of first photoreceptor drums backward after the monochrome image forming process has ended.

2. An image forming apparatus that is a tandem type and performs a monochrome image forming process and a color image forming process, the image forming apparatus comprising:

a plurality of first photoreceptor drums that bear a single color toner image on a surface of each of the first photoreceptor drums;

a second photoreceptor drum that bears a black toner image on a surface of the second photoreceptor drum;

an intermediate transfer belt onto which a toner image is transferred from at least one of the plurality of first photoreceptor drums and the second photoreceptor drum in a state in which the intermediate transfer belt is contacted with the plurality of first photoreceptor drums and the second photoreceptor drum;

a plurality of cleaning blades that are slidably contacted with the plurality of first photoreceptor drums and the second photoreceptor drum, respectively, in order to remove toner remaining on the plurality of first photoreceptor drums and the second photoreceptor drum after the toner image is transferred;

a switching mechanism that switches a contact state in which the plurality of first photoreceptor drums and the second photoreceptor drum are contacted with the intermediate transfer belt to a separation state in which the plurality of first photoreceptor drums and the second photoreceptor drum are separated from the intermediate transfer belt after the color image forming process has ended; and a backward rotating mechanism that rotates the plurality of first photoreceptor drums backward after the switching mechanism has switched the contact state of the plurality of first photoreceptor drums and the second photoreceptor drum, and the intermediate transfer belt to the separation state, wherein the backward rotating mechanism does not rotate the second photoreceptor drum backward.

3. The image forming apparatus according to claim 2, wherein the backward rotating mechanism rotates the plurality of first photoreceptor drums backward by a minute angle.

4. The image forming apparatus according to claim 3, wherein the backward rotating mechanism rotates the plurality of first photoreceptor drums backward by an angle required to release pressure of toner accumulated between the plurality of first photoreceptor drums and the plurality of cleaning blades.

5. The image forming apparatus according to claim 4, wherein the backward rotating mechanism rotates the plurality of first photoreceptor drums backward by several millimeters of a peripheral length of the first photoreceptor drums.

* * * * *